US008887763B2

(12) United States Patent
Cortellini et al.

(10) Patent No.: US 8,887,763 B2
(45) Date of Patent: Nov. 18, 2014

(54) ARM MADE OF COMPOSITE MATERIAL AND RELATIVE PRODUCTION METHOD

(75) Inventors: Mauro Marco Cortellini, Rozzano (IT); Paolo Dario Maini, Monza (IT); Andrea Bernasconi, Milan (IT); Stefano Beretta, Voghera (IT)

(73) Assignee: Cifa SpA, Senago (IT)

( * ) Notice: Subject to any disclaimer, the term of this patent is extended or adjusted under 35 U.S.C. 154(b) by 584 days.

(21) Appl. No.: 12/726,530

(22) Filed: Mar. 18, 2010

(65) Prior Publication Data

US 2010/0282701 A1 Nov. 11, 2010

(30) Foreign Application Priority Data

May 6, 2009 (IT) ..... UD2009A0090

(51) Int. Cl.
*E03B 1/00* (2006.01)
*E04G 21/04* (2006.01)
*B66C 23/70* (2006.01)

(52) U.S. Cl.
CPC ..... *B66C 23/70* (2013.01); *E04G 21/04* (2013.01)
USPC ..... 137/615; 138/155

(58) Field of Classification Search
USPC ..... 212/347, 348, 349, 350; 285/285.1, 285/294.3, 295.1, 296.1, 915, 919; 403/265–268; 138/155, 120, 109; 137/615; 141/387
See application file for complete search history.

(56) References Cited

U.S. PATENT DOCUMENTS

| | | | | |
|---|---|---|---|---|
| 3,087,581 | A | 4/1963 | Pitman | |
| 3,352,577 | A * | 11/1967 | Medney | 285/246 |
| 3,503,636 | A * | 3/1970 | Bower | 285/305 |
| 3,947,191 | A | 3/1976 | Milner, Jr. | |
| 5,511,831 | A * | 4/1996 | Barton | 285/382 |
| 8,082,719 | B2 * | 12/2011 | Bagepalli | 52/849 |
| 2005/0011560 | A1 * | 1/2005 | Anderson et al. | 137/615 |
| 2008/0283176 | A1 * | 11/2008 | Bottacin | 156/158 |

FOREIGN PATENT DOCUMENTS

| | | |
|---|---|---|
| EP | 1 970 344 A1 | 9/2008 |
| EP | 2 039 498 A2 | 3/2009 |
| JP | 2002-46993 | 2/2002 |

* cited by examiner

*Primary Examiner* — Sang Kim
*Assistant Examiner* — Nathaniel Adams
(74) *Attorney, Agent, or Firm* — Novak Druce Connolly Bove + Quigg LLP

(57) ABSTRACT

An arm made of composite material, and relative production method, consisting of a plurality of articulated segments with a longitudinal main axis (x), pivoted to each other, each of the articulated segments comprising a box-like structure and at least a joint element attached thereto by means of gluing, the box-like structure having an end cooperating with an end of the joint element on the inside of the surface of the joint element. The ends define a substantially conical reciprocally overlapping area and have profiles concordantly inclined by an angle (α) with respect to the longitudinal axis (x).

20 Claims, 3 Drawing Sheets

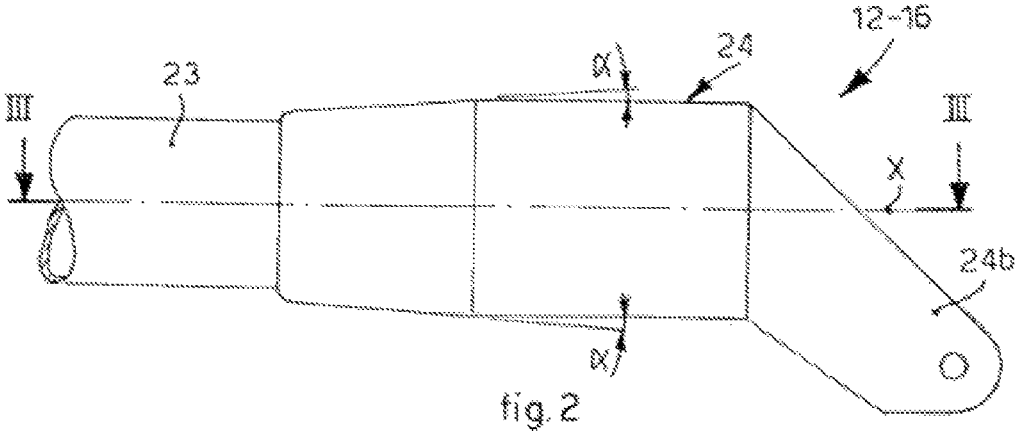
fig. 2
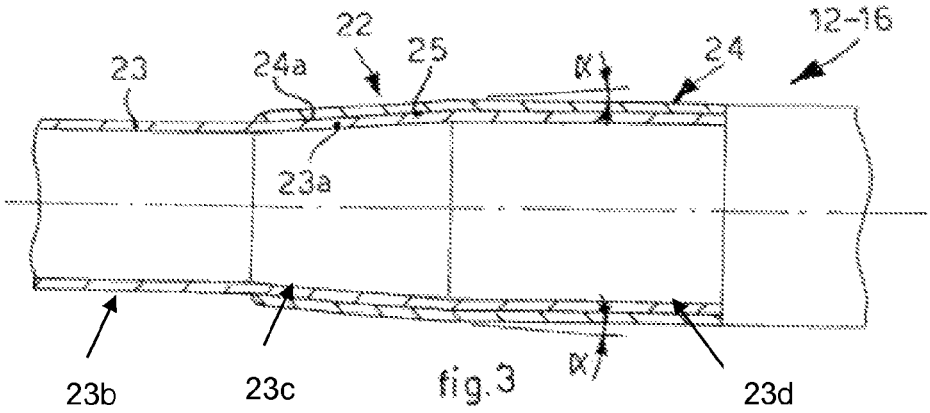
fig. 3
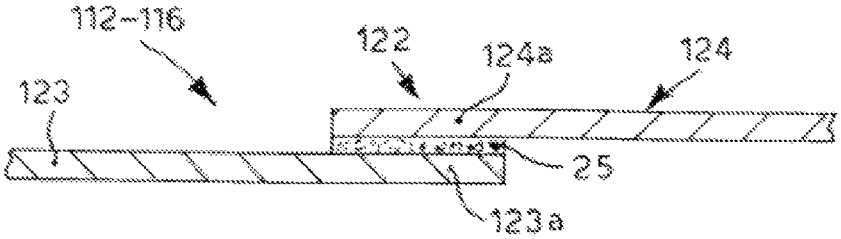
fig. 4 (STATE OF THE ART)
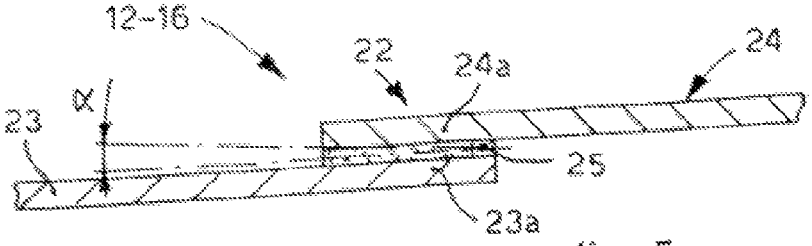
fig. 5

ARM MADE OF COMPOSITE MATERIAL AND RELATIVE PRODUCTION METHOD

CROSS-REFERENCE TO RELATED APPLICATION

This application claiming the priority of Italian Patent Application No. UD2009A000090 filed on 6 May 2009.

FIELD OF THE INVENTION

The present invention concerns an arm made of composite material and the relative production method.

In particular, the present invention is advantageously applied particularly on concrete mixers or the like, and even more particularly in all those cases in which the arms of these vehicles are required to reach large total heights and lengths, and support considerable weights. Advantageously it is preferably applied in the building sector, for the distribution of concrete or other similar material, and it is preferably of the type comprising a plurality of articulated segments pivoted with respect to each other at the ends.

BACKGROUND OF THE INVENTION

Heavy work vehicles used in the building sector are known, usually consisting of a truck on which an arm is assembled which has a plurality of articulated segments pivoted with respect to each other at the ends. The arm can be oriented, extended and/or telescopically opened for the distribution of concrete or similar material. The arm is able to reach considerable distances from the truck so as to guarantee maximum flexibility of use of the heavy work vehicle. The overall weight of the arm increases with the increase in distance which it can reach, and this depends on the number and the length of the articulated segments which make it up. The need for flexibility therefore conflicts with the limits of bulk and weight of the arm itself.

From the European patent application EP-08164624.2, in the name of the present Applicant, an extendable arm is known for the distribution of concrete, at least partly made of composite material so as to reduce the weight of the arm, given the same extension reached, with respect to a traditional arm made of metal material. The composite material has good characteristics of resistance and rigidness, but also greater lightness.

Based on the idea of using composite material for the construction of the articulated arm, the European patent application EP-08152672.5, also in the name of the present Applicant, shows a possible construction technique for the arm, which aims to reduce production costs, guaranteeing maximum flexibility and versatility of production. According to this technique each main box-like structure of the segments of the arm is formed by depositing a predefined plurality of layers of pre-impregnated composite material in a forming mold. Then this box-like structure made of composite material is subjected to polymerization and, once removed from the mold, terminal joint elements are attached to it in order to attach it to other adjacent segments, in order to form, once assembly is completed, an arm with articulated segments. At the same time as the arms were designed, an experiment was made with a gluing technique to glue the box-like structure to a joint element so as to form a complete segment. More specifically, in FIG. 4 a gluing area 122 between ends 123*a* and 124*a* is schematically shown, belonging respectively to a box-like structure 123 and to a joint element 124 of a generic articulated segment 112-116. The ends 124*a* of the element

124 are coupled parallel and glued on the outside to the respective ends 123*a* of the structure 123 by means of a layer of glue, or other adhesive material 25 interposed. The angle formed between the longitudinal axis of the box-like structure 123 and the profile of the end 123*a* of the box-like structure 123 is zero. Experimental tests showed that, during the action of the arm, on the layer of glue 25 a shearing power is exerted coincident with the axial force generated by a flexion moment applied. The axial force is parallel to the longitudinal axis of the articulated segment 112-116 considered. It was shown experimentally that the tension state, and therefore the resistance criterion for the layer of glue 25, is dominated, for the most part, by the action of the shearing force, defined as that force which tends to make the overlapping ends 123*a* and 124*a* slide one on top of the other.

One disadvantage of this gluing method is that the layer of glue 25 is in a high state of tension when the articulated segment 112-116 is in use. Indeed the shearing force is high, coinciding with the axial force applied. Consequently, the stresses which affect the layer of glue interposed between the boxed beams and the terminal joint are high, and the fatigue damage is significant, resulting in a limited working life of the articulated segment and therefore of the arm which it comprises.

Purpose of the present invention is to make an element, or segment, of an articulated arm in which the technique of connecting the boxed beam and terminal joint allows to lengthen the duration of the working life of the arm.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, an arm made of composite material according to the present invention consists of a plurality of articulated segments with a main longitudinal axis, pivoted to each other at the ends. The arm, in the transport position, has its constituent segments bent back one on the other so as to take up as little bulk as possible, while, in the work position, the segments are all or partly extended or unfolded in order to reach the desired distance. Each articulated segment according to the invention comprises a box-like structure made of composite material and at least a joint element, attached by means of gluing to the box-like structure so as to allow connection with another adjacent segment of the articulated arm. The box-like structure has one end cooperating with an end of the joint element on the inside of the surface of the joint element, defining an overlapping area.

According to a characteristic feature of the present invention, the overlapping area between the end of the box-like structure and the mating end of the joint element defines a substantially conical coupling. Substantially conical coupling means, here and hereafter, an area of coupling belonging to a conical or truncated cone surface, in which the ends of the box-like structure and the joint element to be reciprocally glued have profiles which are concordantly inclined at the same angle with respect to the main axis of the articulated segment. This type of coupling allows to increase the overlapping area with respect to the case with no inclination, reducing the tangential stresses which affect the layer of glue interposed between the two ends to be connected, given the same load applied.

According to a variant of the present invention, the angle of inclination of the profiles of the ends of the box-like structure and of the joint element is comprised between 1 and 5 degrees inclusive. The choice of this range depends on the fact that an inclination value of less than 1 degree would be insufficient to determine an appreciable increase in the gluing area with respect to the case in which this inclination was zero. On the other hand, a value higher than 5 degrees would imply a considerable increase in the overlapping area, but would have the disadvantage of generating a normal force to the main longitudinal axis not negligible in modulus, tending to separate the parts made of composite material.

According to a further variant of the present invention, the angle of inclination is comprised between 2.5 and 3.5 degrees. This range is particularly advantageous as it determines an optimal compromise between the overlapping area generated, which should be as big as possible, and the normal force modulus acting on the layer of glue, which should be as low as possible.

BRIEF DESCRIPTION OF THE DRAWINGS

These and other characteristics of the present invention will become apparent from the following description of a preferential form of embodiment, given as a non-restrictive example with reference to the attached drawings wherein:

FIG. 2 is a detailed view of a portion of articulated segment which is comprised in an extendable arm according to the invention;

FIG. 3 is a section from III to III of a portion of articulated segment which is comprised in an extendable arm according to the invention;

FIG. 4 is a schematic representation of a detail of an articulated segment of an arm;

FIG. 5 is a schematic representation of a detail of an articulated segment of an arm.

DETAILED DESCRIPTION OF A PREFERENTIAL FORM OF EMBODIMENT

Figure 1:
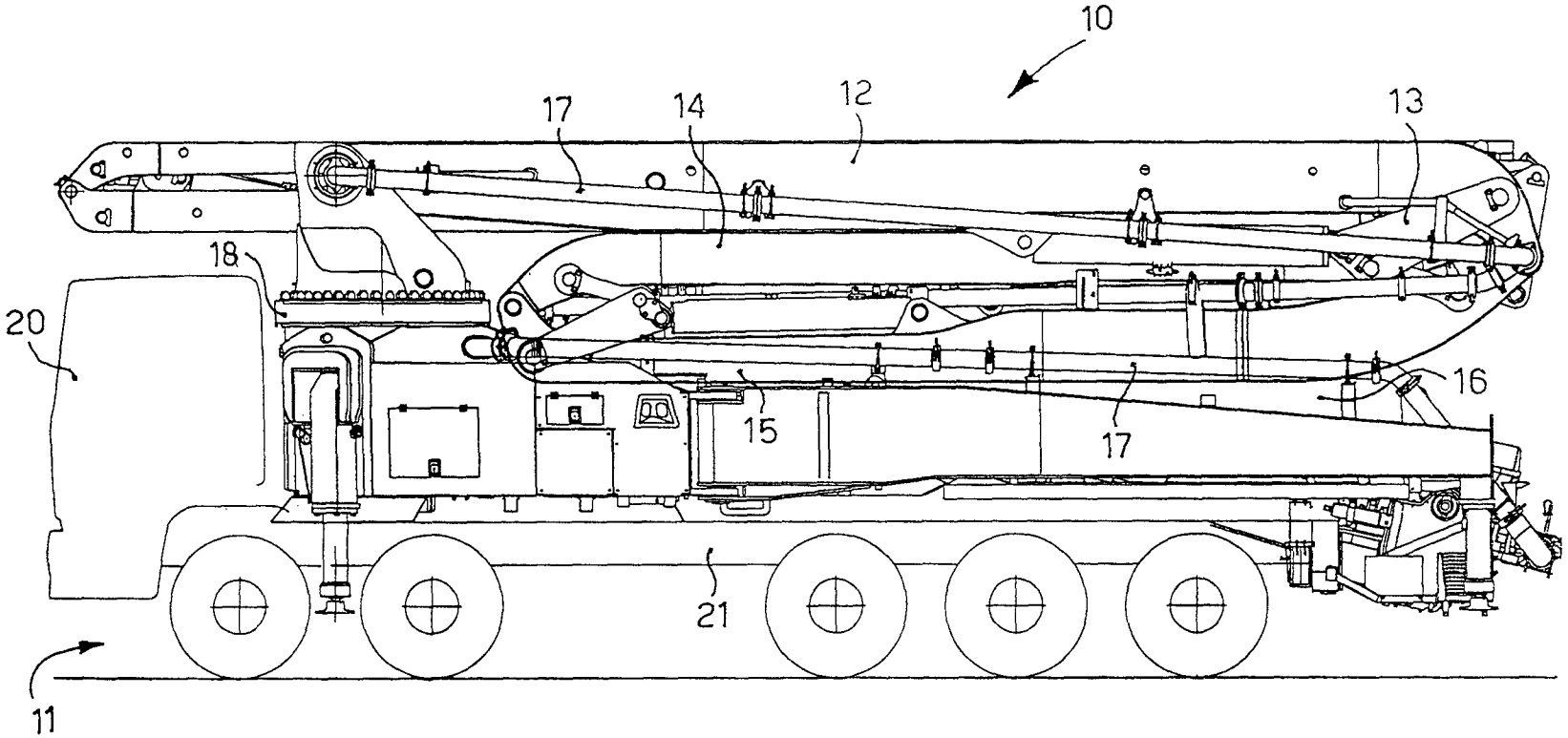
FIG. 1 is a lateral view of a heavy work vehicle on which an arm made of composite material according to the present invention is installed, in a folded condition used for transport.
Figure 6:
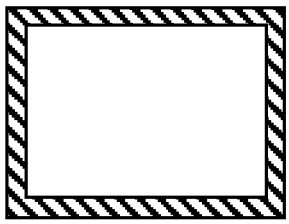

With reference to FIG. 1, an arm made of composite material 10 according to the present invention, able to distribute concrete or similar material for the building trade, is shown in an assembled position on a heavy work vehicle 11, in a folded position for transport. The heavy vehicle 11 comprises a drive cabin 20 and a support bench 21 on which the arm made of composite material 10 is assembled. The arm 10 according to the present invention comprises a plurality of articulated segments, in this case five, respectively, a first 12, a second 13, a third 14, a fourth 15 and a fifth 16, pivoted with respect to each other at their respective ends. There is also a pipe 17, to feed and discharge the cement. With reference to FIG. 1, the first segment 12, in a known manner, is pivoted to a turret 18, and can be rotated with respect to it. The other segments 13-16 are pivoted in sequence with respect to each other at respective ends and can be driven individually, by means of actuators, according to specific needs. Each segment 12-16 is used to carry a pipe inside which the concrete flows, sent by a feed pump (not shown). A segment of flexible pipe (not shown), from which the concrete is delivered to the application place, is normally connected to the last segment. It is understood that the illustration in FIG. 1 is only an example, and must in no way be considered as restricting the field of protection to which the present invention refers.

FIG. 2 shows a portion of articulated segment 12-16 comprising a portion of box-like structure 23 a joint element 24. As shown in FIG. 3, the box-like structure 23 can comprise a main body portion 23*b*, an inclined body portion 23*c*, and an extended body portion 23*d*. As further shown in FIG. 3 and in the schematic drawing in FIG. 5, the box-like structure 23 has an end 23*a* with a profile inclined by an angle $\alpha$ with respect to the longitudinal axis x of the box-like structure 23. The same inclination is made on an end 24*a* of the joint element 24. The element 24, at the opposite end, has a connection terminal 24*b* for articulation to another articulated segment 12-16 of the arm 10. The ends 24*a* of the joint element 24 cooperating with the respective ends 23*a* of the box-like structure 23 are glued on the outside of the surface of the box-like structure 23, defining an overlapping area, or conical coupling area, 22, where a layer of glue 25 is interposed. The axial force, the effect of a flexion moment applied to the arm 10 in movement, is locally resolved into two components, a shearing force and a normal force. The modulus of the shearing force, responsible for the sliding of the contact surfaces 23*a* and 24*a* one on top of the other, is less than the modulus of the shearing force applied between two ends 123*a* and 124*a* with a profile having zero inclination (FIG. 4), all other conditions being the same. The normal component of the axial force is responsible for the separation of the glued ends 23*a* and 24*a* but, in the case of inclined profiles glued together, its modulus is negligible because the angle $\alpha$ is sufficiently small. The normal component is zero I the case of ends 123*a* and 124*a* having profiles with a zero angle of inclination with respect to the longitudinal axis "x" (FIG. 4). In this last case, the axial force coincides with the shearing force.

It is clear that modifications and/or additions of parts may be made to the arm made of composite material and the method to produce it as described heretofore, without departing from the field and scope of the present invention.

It is also clear that, although the present invention has been described with reference to some specific examples, a person of skill in the art shall certainly be able to achieve many other equivalent forms of arm made of composite material and the method to produce it, having the characteristics as set forth in the claims and hence all coming within the field of protection defined thereby.

The invention claimed is:

1. An arm made of composite material, comprising:

a plurality of articulated segments with a longitudinal main axis (x), pivoted to each other, each of said articulated segments comprising a tubular structure and at least a joint element attached thereto by gluing, wherein the tubular structure has a main body portion and a first end which has a flared portion, wherein the joint element has a second end which is hollow and has a tapered portion, wherein the joint element comprises an extended joint portion extending from the tapered portion, the tapered portion tapering away from the extended joint portion, the extended joint portion comprising substantially parallel sidewalls and a third end opposed to the second end, wherein the substantially parallel side walls are substantially parallel to the longitudinal main axis (x), said tubular structure first end cooperating with the second end of the joint element on an inside surface of the joint element, wherein said first and second ends define a substantially conical reciprocally overlapping coupling area and have profiles concordantly inclined by an angle (α) with respect to the longitudinal axis (x), wherein the flared portion is within the tapered portion at the conical coupling area, and wherein the outer surface of the flared portion is glued to the inner surface of the tapered end at the conical coupling area.

2. The arm made of composite material as in claim 1, wherein said angle (α) of inclination is between 1 and 5 degrees.

3. The arm according to claim 1, wherein the arm is for distribution of concrete and dimensioned for use on a truck and wherein said joint element is attached to said tubular structure by gluing.

4. The arm according to claim 1, wherein the tubular structure flared portion is integral with the tubular structure and the joint element tapered portion is integral with the joint element.

5. An arm according to claim 1, wherein the third end is for being rigidly connected to a connection terminal for articulation to an additional articulated segment of the arm.

6. The arm made of composite material as in claim 5, wherein said angle (α) of inclination is between 2.5 and 3.5 degrees, wherein the tubular structure first end further comprises an additional tubular section extending from the flared portion proximally towards the third end.

7. The arm according to claim 5, wherein the first end of the tubular structure terminates within the coupling area and the third end of the joint element extends beyond the coupling area such that the first end of the tubular structure is separated from the additional articulated segment of the arm.

8. The arm according to claim 1, wherein the articulated segment tubular structure and joint element each extend in opposed directions beyond the substantially conical reciprocally overlapping coupling area.

9. The arm according to claim 8, wherein said angle (α) of inclination is between 1 and 5 degrees.

10. The arm according to claim 8, wherein each articulated segment structure is formed of pre-impregnated composite material subjected to polymerization.

11. The arm according to claim 8, wherein the tubular structure flared portion is integral with the tubular structure and the joint element tapered portion is integral with the joint element.

12. A method to make an arm made of composite material comprising a plurality of articulated segments with a longitudinal main axis (x), pivoted to each other, each of said articulated segments comprising a tubular structure and at least a joint element attached thereto by gluing, said tubular structure having a first end cooperating with a second end of the joint element on an inside surface of the joint element, the method comprising:

a step in which said tubular structure and said joint element are made separately and in such a manner that at least one of the first end and the second end has a profile inclined by an angle (α) with respect to the longitudinal axis (x), and a step in which said first and second ends are concordantly glued, making a substantially conical joint in such a manner that said first and second ends define a substantially conical reciprocally overlapping coupling area, wherein the joint element second end is hollow and has a tapered portion, wherein the joint element comprises an extended joint portion extending from the tapered portion, the tapered portion tapering away from the extended joint portion, the extended joint portion comprising substantially parallel sidewalls and a third end opposed to the second end, wherein the substantially parallel side walls are substantially parallel to the longitudinal main axis (x);

wherein the tubular structure first end has a flared portion, wherein the tubular structure having the first end cooperating with the second end of the joint element on an inside surface of the joint element comprises the flared portion being within the tapered portion at the conical coupling area, and wherein the outer surface of the flared portion is glued to the inner surface of the tapered end at the conical coupling area.

13. The method as in claim 12, wherein said angle (α) of inclination is between 1 and 5 degrees.

14. The method according to claim 12, wherein the arm is for distribution of concrete and dimensioned for use on a truck and wherein joint element is attached to said tubular structure by gluing.

15. The method according to claim 12, wherein the articulated segment and joint element each extend in opposed directions beyond the substantially conical reciprocally overlapping coupling area; and wherein the tubular structure flared portion is integral with the tubular structure and the joint element tapered portion is integral with the joint element.

16. A method according to claim 12, wherein the third end is rigidly connected to a connection terminal for articulation to an additional articulated segment of the arm.

17. The method as in claim 16, wherein said angle (α) of inclination is between 2.5 and 3.5 degrees, wherein the tubular structure first end further comprises an additional tubular section extending within the joint element from the flared portion proximally towards the third end.

18. The method according to claim 16, wherein the first end of the tubular structure terminates within the coupling area and the third end of the joint element extends beyond the coupling area such that the first end of the tubular structure is separated from the additional articulated segment of the arm.

19. An arm comprising a plurality of articulated segments, wherein each of the plurality of articulated segments comprises:

a tubular structure comprising:

a main body portion, an inclined body portion, and an extended body portion; and a joint element, wherein the main body portion, the inclined body portion, and the extended body portion are substantially aligned along a longitudinal main axis (x), wherein the main body portion is coupled to a first side of the inclined body portion, wherein the extended body portion is coupled to a second side of the inclined body portion, wherein the first side of the inclined body portion is opposed to the second side of the inclined body portion, wherein the main body portion and the extended body portion comprise substantially parallel side walls, wherein the substantially parallel side walls are substantially parallel to the longitudinal main axis (x), wherein a first cross-section width of the main body portion is less than a second cross-section width of the extended body portion, wherein the inclined body portion comprises inclined side walls inclined relative to the longitudinal main axis (x) by an angle (α), wherein the inclined body portion and the extended body portion of the tubular structure are within a concordantly structured portion of the joint element, wherein an exterior surface of the inclined body portion and the extended body portion of the tubular structure are glued to an interior surface of the joint element, wherein the concordantly structured portion of the joint element comprises an inclined wall portion, inclined by the angle ($\alpha$) with respect to the longitudinal axis (x), wherein the inclined body portion and the inclined wall portion of the concordantly structured portion of the joint element overlap to define a substantially conical reciprocally overlapping coupling area.

20. The arm according to claim 19, wherein the articulated segment main body portion and the joint element each extend in opposed directions beyond the substantially conical reciprocally overlapping coupling area and wherein said joint element is attached to said tubular structure by gluing.

* * * * *